United States Patent [19]

Shaffer

[11] Patent Number: 4,736,578

[45] Date of Patent: Apr. 12, 1988

[54] METHOD FOR FORMING A SLUB YARN

[75] Inventor: Donald E. Shaffer, Wilmington, Del.

[73] Assignee: E. I. Du Pont de Nemours and Company, Wilmington, Del.

[21] Appl. No.: 726,385

[22] Filed: Apr. 23, 1985

[51] Int. Cl.[4] ..... D02G 3/34; D02G 3/36; D02J 1/06

[52] U.S. Cl. ..... 57/6; 28/271; 57/208; 57/209; 57/288; 57/350

[58] Field of Search ..... 57/206–209, 57/6, 350, 351, 91, 284, 287, 288, 289; 28/271–276

[56] References Cited

U.S. PATENT DOCUMENTS

| | | | |
|---|---|---|---|
| 3,093,878 | 6/1963 | Fieldman | 57/208 X |
| 3,174,271 | 3/1965 | Edwards et al. | 57/350 X |
| 3,332,125 | 7/1967 | Davis et al. | 57/208 X |
| 3,473,315 | 10/1969 | Lenoir | 57/208 X |
| 3,474,613 | 10/1969 | Joarder et al. | 57/350 X |
| 3,517,498 | 6/1970 | Burellier et al. | 57/91 |
| 3,973,386 | 8/1976 | Gorrafa | 57/350 X |
| 4,218,869 | 8/1980 | Newton | 57/350 X |
| 4,305,245 | 12/1981 | Eschenbach | 57/6 |
| 4,311,000 | 1/1982 | London, Jr. et al. | 57/6 |
| 4,343,071 | 8/1982 | Schroder | 28/254 |
| 4,351,148 | 9/1982 | Eschenbach | 57/209 |

*Primary Examiner*—John Petrakes

[57] ABSTRACT

A method for forming a slub yarn uses conventional false-twist texturing apparatus in combination with one or more air jets to impart striations and/or neps and slubs to continuous filament yarns. Three process configurations are disclosed; each configuration uses one air jet through which yarn passes and which directs turbulent air in a direction opposite to the direction of travel of the yarn.

5 Claims, 2 Drawing Sheets

METHOD FOR FORMING A SLUB YARN

BACKGROUND OF THE INVENTION

This invention relates to novelty slub yarns produced by combining false-twisted continuous filament yarns in one or more air jets.

Processes for producing such yarns are known. For example, U.S. Pat. No. 4,351,148 discloses a method to form a slub yarn by combining a core and effect yarn in a jet wherein the slubs are allowed to form by controlling the path length of the effect yarn using a mechanical deviation device which periodically lengthens the effect yarn's path while the core yarn is supplied directly to the jet at a constant linear velocity. The yarn produced comprises a plurality of slubs produced along its length with a characteristic nub produced at the tail of each slub.

SUMMARY OF THE INVENTION

It has been found that novelty slub yarns can be produced that are devoid of patterning when made into a fabric by providing a synthetic continuous-filament slubbed yarn having a random distribution of slubs formed by entanglement of filaments and yarn loops. In one of the processes for preparing these slubbed yarns two continuous filament false-twisted yarns are continuously supplied to a pair of air jets adjacently located along the path of travel of the yarns. The first one of these jets directs a pulsed stream of turbulent air in a direction opposite to the direction of travel of the yarns while the second one of these jets directs a constant stream of turbulent air in the same direction as the direction of travel of the yarns. The yarns are heated (optional) then wound up on a package. Intermittent operation of the first jet in a uniform manner causes slubs to form with a random distribution. Another embodiment of the process involves using only the first one of the jets. A third preferred embodiment of the process involves feeding one of the false twisted yarns through the first jet wherein the pulsed stream of turbulent air is directed opposite to the direction of travel of the yarn and then combining the other false twisted yarn of the pair of yarns and feeding both yarns to the second jet wherein a constant stream of turbulent air is directed in the direction of travel of the yarns.

The above processes are conveniently operated by mounting air texturing jets at appropriate locations on existing false-twist-texturing machines such as the Scragg SDS-II or Barmag FK6-900. Suitable air texturing jets include those shown in British Pat. Nos. 2,093,872 and 1,530,252 and U.S. Pat. Nos. 3,545,057 and 4,157,605.

The two feed yarns used in this process preferably differ in orientation and in denier per filament and may exhibit different filament cross sections or be of different polymer compositions.

DETAILED DESCRIPTION

Figure 1:
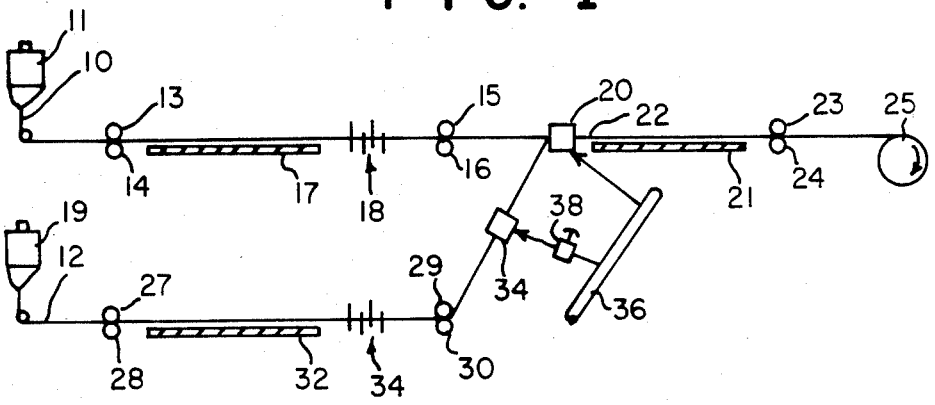
FIG. 1 is a schematic representation of the apparatus and process for one embodiment of the invention.

Referring now to FIG. 1 two yarns 10, 12 are combined in an air jet 20 to produce a slub yarn 22 which is delivered by takeup nip rolls 23, 24 through heater 21 to windup roll 25. The yarn 10 is delivered from package 11 to the false twist zone by the first pair of delivery rolls 13, 14. The second pair of delivery rolls 15, 16 draw the yarn 10 as it passes through heater 17 and the false twist device 18, illustrated as friction discs, and supplies it to jet 20.

The yarn 12 is delivered from package 19 by the delivery rolls 27, 28 and is drawn by delivery rolls 29, 30 as it passes through heater 32 and false-twist device 34, illustrated as friction discs. From the rolls 29, 30 the yarn 12 is delivered to jet 20 (i.e., a second jet) through jet 34 (i.e., a first jet). Both jets 20 and 34 are the same type; the jets are supplied with pressurized air from a common manifold 36. The pressurized air is connected directly to jet 20 while it is connected to jet 34 through valve 38 which may be a solenoid valve with manual or electronic control that can be operated in an intermittent fashion.

Figure 4:
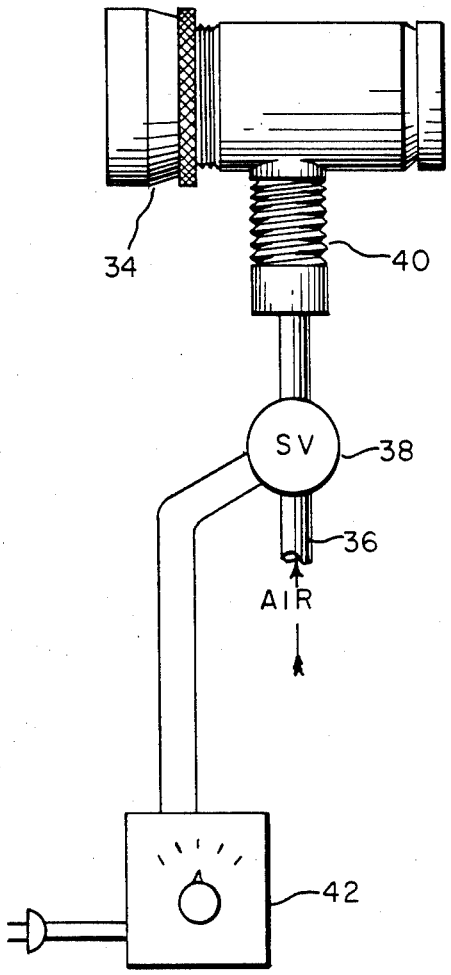
FIG. 4 is a schematic representation of apparatus for intermittent operation of one of the jets used in the method of the invention.

As best shown in FIG. 4, the preferred embodiment includes a solenoid valve 38 connected between the inlet 40 of jet 34 and the air manifold 36. An electronic timer 42 comprising Agastat® timers models SCFXX902XXA and SCFXX900XXA by the American Corporation Control Products Division of Union, N.J. is connected to the solenoid valve control thereof. The solenoid valve preferably may be a model No. 4637K24 by McMaster-Carr. The valve 38 is normally closed and opens on application of electrical current from timer 42. The timer supplies current in a uniform (rather than random) manner to provide uniform pulsed operation of valve 38. A surprising feature of the invention is that uniform operation of valve 38 gives yarn with randomly distributed slubs. Thus, there is no need for the use of elaborate mechanisms, such as a random signal generator, to provide random impulses to the valve.

In the process of FIG. 1, yarns 10 and 12, preferably having different orientations and different dpf's, are draw textured on adjacent positions of a conventional false-twisting texturing machine and then combined by overfeeding to air texturing jet 20 which is oriented so that the direction of air flow assists the passage of yarn through the jet. Before reaching jet 20, false-twist-textured yarn 12 passes through air-texturing jet 34 which is oriented so that its air flow opposes the passage of yarn. Intermittent operation of jet 34 causes neps and slubs to form in the yarn. The size and frequency of the slubs may be adjusted by adjusting the frequency of interruption of air flow to jet 34. Interruption may be regular or random. Downstream from jet 20 the treated yarn, if desired, may be heated to set the textured conformation, and then is delivered to a conventional windup 25.

Figure 2:
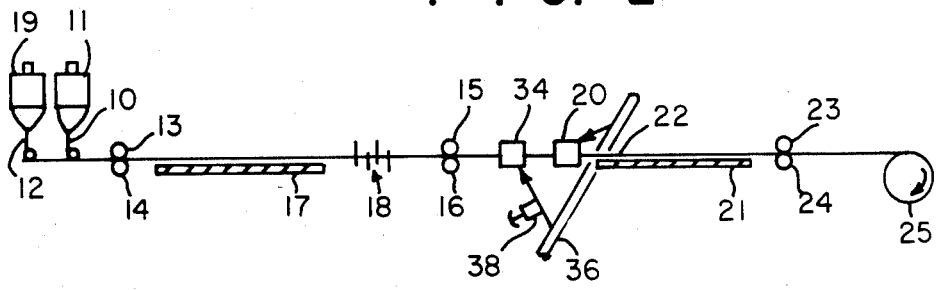
FIG. 2 is a schematic representation of another embodiment of the invention.

In the embodiment shown in FIG. 2 wherein like elements are numbered the same as FIG. 1, the yarns, 10, 12 are false-twisted on the same position of a false-twist-texturing machine and then passed through jets 34, and 20 before being heat set in heater 21 (optional) and wound up on takeup roll 25.

In the process depicted in FIG. 2, yarns 10, 12 are draw textured on the same position of a false-twist-texturing machine and then passed through air texturing jets 34 and 20 respectively before being heat set and wound up. Jet 34, the first jet encountered, is oriented so that the direction of air flow opposes the passage of yarns and is operated intermittently. If two feed yarns 10, 12 of different orientation are used, cotexturing enhances the difference in filament length inherent in the yarns. The process of FIG. 2 usually gives slub and striation denier variations larger than those given by the process of FIG. 1.

Figure 3:
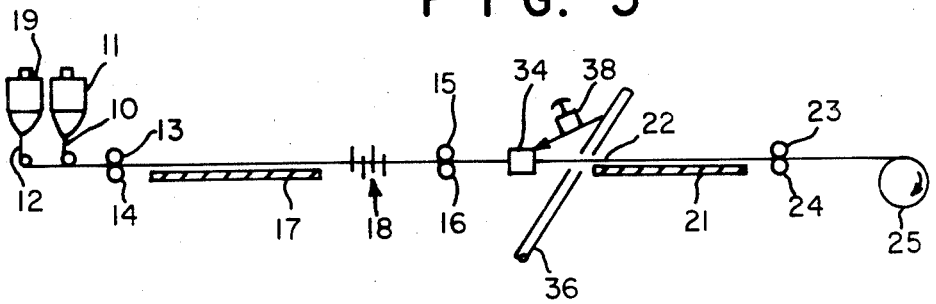
FIG. 3 is a schematic representation of a third embodiment of the invention.

The embodiment shown in FIG. 3 differs from that of FIG. 2, again like elements have the same numbers, in that only one jet, jet 34, is used and operates as before intermittently and air flow opposes passage of the yarns through the jet. Fabrics from the yarns of this process exhibit a reduction in spun-like hand when composed with fabrics from processes of FIGS. 1 and 2.

I claim:

1. In a method for forming a slub yarn from a plurality of yarns (10, 12) in one jet (20) wherein the slubs are allowed to form by controlling the path length of one of the yarns (12) upstream of said one jet (20), the improvement comprising: maintaining the path length of said one yarn (12) constant while passing said one yarn through a first air jet (34) located upstream of said one jet (20), said first jet (34) directing an intermittent stream of turbulent air in a direction opposite to the direction of travel of said one yarn.

2. The method of claim 1 wherein said plurality of yarns (10, 12) are false-twist textured before passing through said jets (34, 20).

3. The method of claim 2 wherein all of said plurality of yarns are passed through said first jet (34) prior to passing through said one jet (20).

4. A method for forming a slub yarn comprising the steps of feeding a plurality of yarns (10, 12) at a constant linear velocity through an air yet (34), said jet directing an intermittent stream of turbulent air in a direction opposite to the direction of travel of said yarns, forming a slub yarn (22) in said jet (34) and withdrawing said slub yarn (22) from the jet (34).

5. The method of claim 4 wherein said yarn (10, 12) is draw-textured before passing through said jet (34).

* * * * *